United States Patent [19]

Baker

[11] Patent Number: 4,573,220

[45] Date of Patent: Mar. 4, 1986

[54] BILLIARD GLOVE

[76] Inventor: Terry L. Baker, P.O. Box 206, Armuchee, Ga. 30105

[21] Appl. No.: 641,867

[22] Filed: Aug. 17, 1984

[51] Int. Cl.[4] ..... A41D 19/00

[52] U.S. Cl. ..... 2/161 A; 2/21; 2/163; 2/169

[58] Field of Search ..... 2/161 A, 21, 16, 159, 2/163, 167, 169

[56] References Cited

U.S. PATENT DOCUMENTS

| | | | |
|---|---|---|---|
| 2,443,375 | 6/1948 | Burkholz | 2/169 |
| 2,751,592 | 6/1956 | Longstreth et al. | 2/21 |
| 3,588,917 | 6/1971 | Antonious | 2/161 A |
| 3,787,898 | 1/1974 | Walker | 2/163 |
| 4,025,962 | 5/1977 | Hartung | 2/161 A |
| 4,064,563 | 12/1977 | Stokes | 2/161 A |
| 4,103,362 | 8/1978 | Blakeman | 2/161 A |

*Primary Examiner*—Werner H. Schroeder
*Assistant Examiner*—Judith L. K. Olds
*Attorney, Agent, or Firm*—Newton, Hopkins & Ormsby

[57] ABSTRACT

A glove for use in billiards which can be worn on either hand of the player to cover the thumb, index finger, and middle finger of the hand. A first member of the glove is formed with a thumb portion, index finger portion, middle finger portion and hand portion. A second member symmetrical to the first member is formed with a thumb, index finger, middle finger and hand portions corresponding to those of the first member. A slit opening is formed in each hand portion extending in close proximity to the junction between the thumb and index finger. The two members are stitched together along the edges with straight edge stitching except for the hand portions which remain open to accommodate ring and little fingers. An elastic band and fastener are stitched to one of the members. The material of the members is soft and stretchable to accommodate a range of hand sizes and has tiny openings formed therein for ventilation and comfort.

5 Claims, 4 Drawing Figures

BILLIARD GLOVE

BACKGROUND OF THE INVENTION

1. Field of the Invention

This invention relates to an improved glove for use in sports and, particularly, billiards for a player to shift a single glove to both hands.

2. Description of the Prior Art

It is known to have gloves for players of particular sports, such as billiards. In billiards, the player frequently wears a glove around the thumb, index finger and middle finger where contact is made with the cue stick. It is important that this area of the hand be trouble free in handling the stick to provide maximum skill as well as enjoyment to the game. Billiard gloves of this type are described, for example, in U.S. Pat. No. 4,103,362 to Blakeman and U.S. Pat. No. 4,064,563 to Stokes. There are still other patents to different types of sport gloves as described in U.S. Pat. Nos. 2,949,610 and 3,096,523.

Heretofore, billiard gloves have not been entirely satisfactory from the standpoint that the glove cannot be easily shifted from one hand to the other. This is important to a player who must make both left and right hand shots with a glove on the appropriate hand. It should be understood that only the hand controlling the tip of the cue stick need have a glove.

Furthermore, the glove must fit comfortably, not cause sweating, be long lasting and stretch to accomodate a range of hand sizes. More than this, the glove should be simple to manufacture and be relatively inexpensive.

SUMMARY OF THE INVENTION

Accordingly, a primary object of this invention is to provide an improved glove for use in sports, such as billiards where the glove may be shifted for use on either hand of the player without detracting from skill or comfort of the player.

Another object of invention is to provide a glove that is comfortable to wear and easy to put on and take off.

Still another object of the invention is to provide a glove that is both simple to make and relatively inexpensive.

Still another object of the invention, is to provide a glove for the billiard players to improve the comfort and skill of the player.

According to the instant invention, a two-handed glove is formed by two members that are symmetrical with each having edges defining a thumb portion, an index finger portion, a middle finger portion and a hand portion. When stitched together in straight edge fashion along the edges of the thumb, index finger and middle finger portions, and turned inside out a smoothly fitted glove is formed for use on the right and left hand of a player. Now the player can shift the glove from hand to hand without detracting from his skill.

Another aspect of the invention is that the hand portion of each member is formed with a slit opening extending towards and in close proximity of the junction between the thumb and index finger portions. The slit openings are stitched closed separately to enable a proper fit and form for use on either hand, as well as firmness.

Another aspect of the invention is that the glove is made of stretchable, soft material formed with tiny ventilation openings for comfort. Any suitable material can be used, such as nylon. An elastic, adjustable band is stitched to the end of the sections for ease in wearing and removing the glove. Further to this, the glove can be sprayed with a silicone lubricant to enhance the finish thereof.

BRIEF DESCRIPTION OF THE DRAWINGS

A more complete appreciation of the invention may be had by reference to the following description when considered in connection with the accompanying drawings in which.

DETAILED DESCRIPTION OF THE INVENTION

Figure 1:
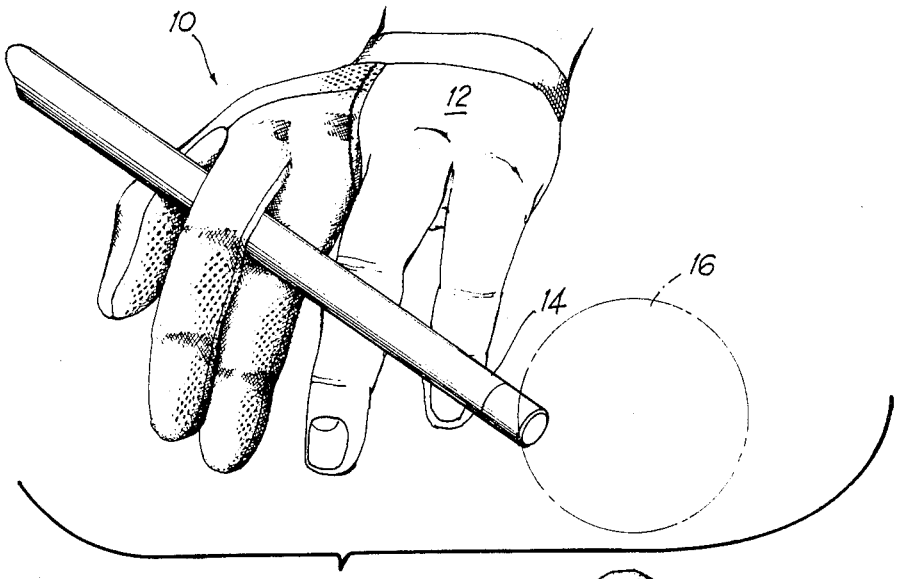
FIG. 1 is a perspective view that illustrates the glove of the invention on the hand of a billiard player in position for a shot.
Figure 2:
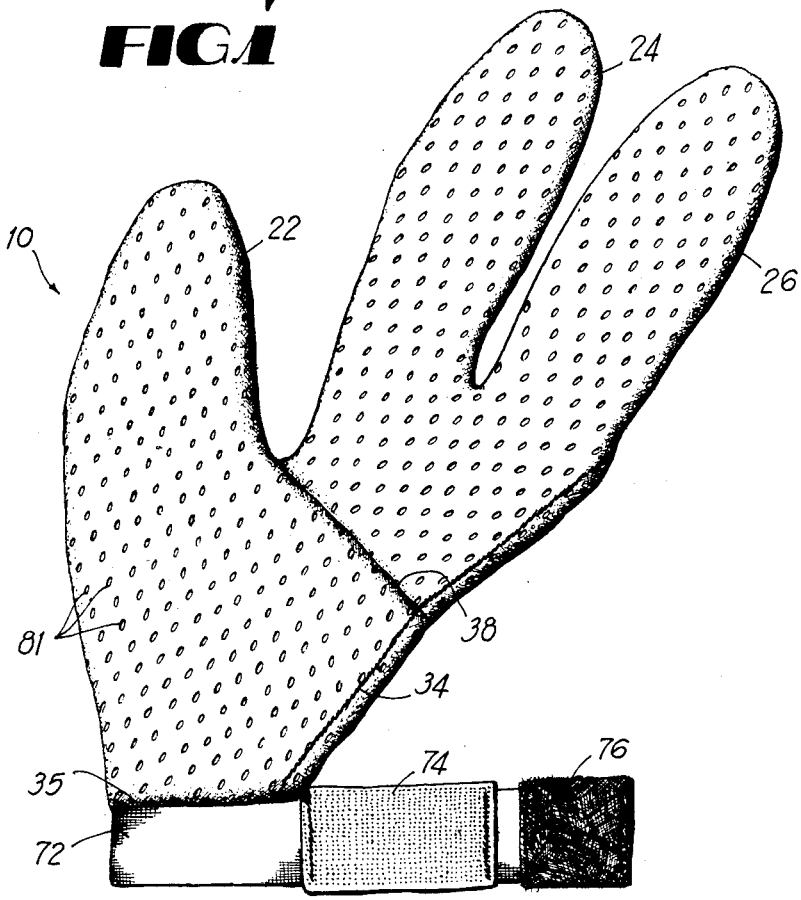
FIG. 2 is side elevational view of the glove as shown in FIG. 1.

Referring now to the drawings, there is shown in FIG. 1, a glove 10 according to the present invention on the hand 12 of a billiard player handling the tip of a billiard stick or cue 14 in position for a shot at a ball 16 shown in broken lines. It will be noted that the glove covers the thumb, index finger and middle finger, but leaves uncovered the ring and little fingers of the player's hand. The thumb, index and middle fingers handle the cue while the ring and little fingers are manipulated to form the necessary shooting base or arch relative to the table and ball. At times the player may wish to shoot with either hand due to the nature of the shot. With the instant invention, the player may shift the glove from one hand to the other without sacrifice in comfort and skill in the handling of the cue and positioning thereof. FIG. 2 shows an enlarged view of the glove 10 removed from the player's band.

Figure 3:
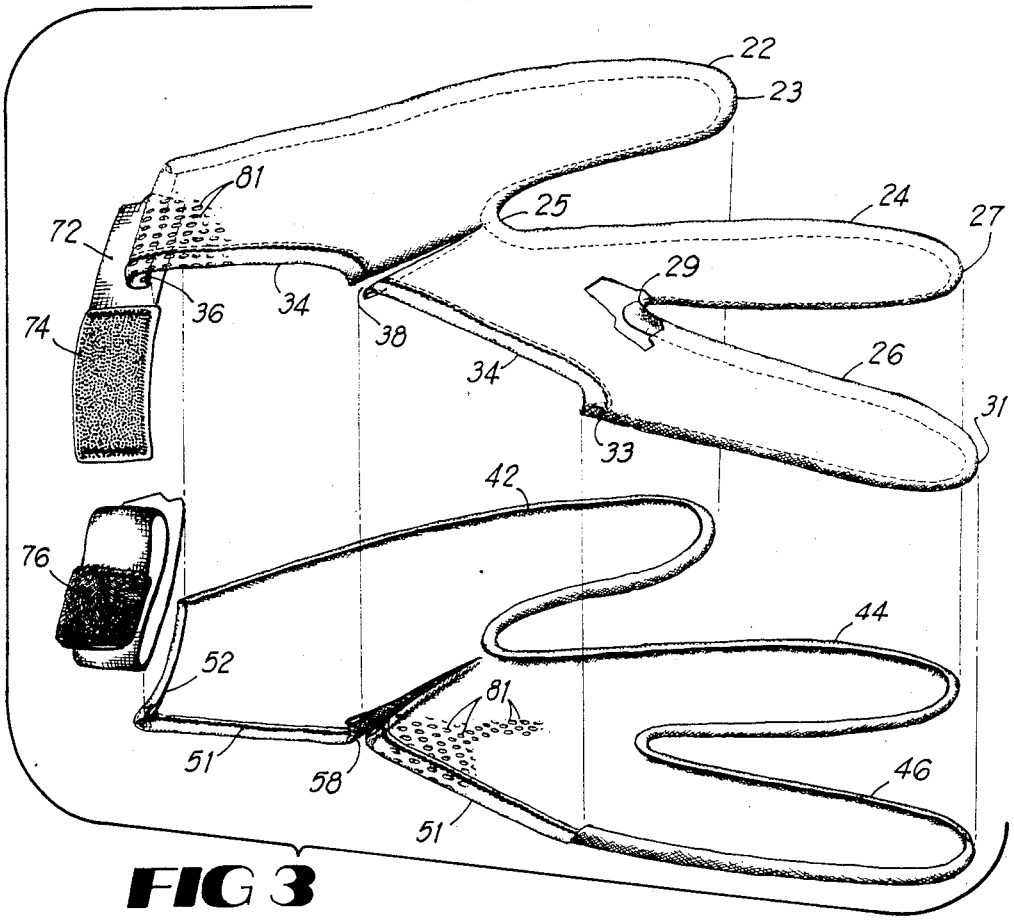
FIG. 3 is an exploded view of the sections of the glove prior to stitching.
Figure 4:
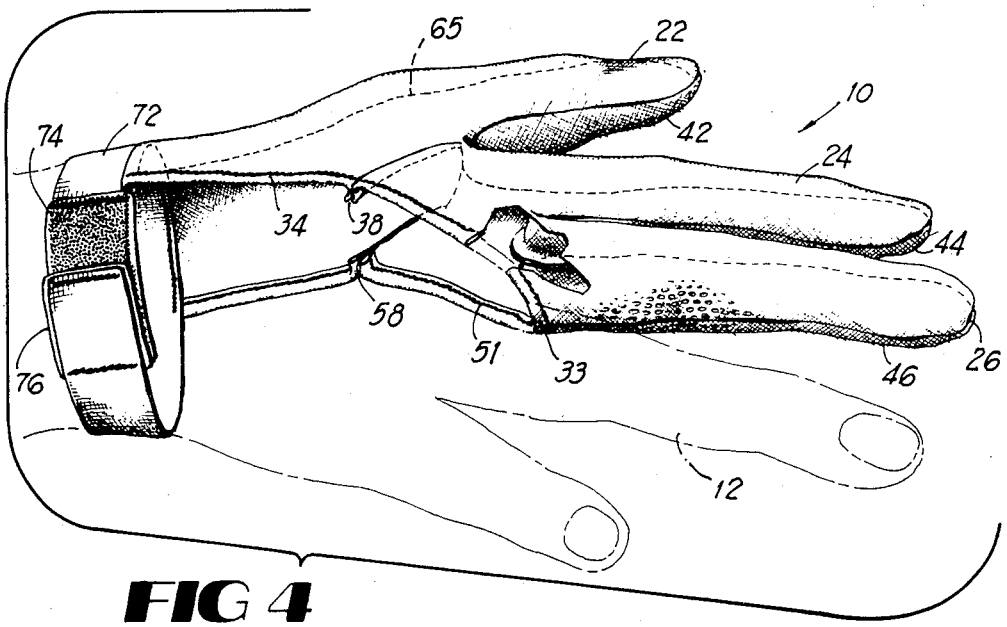
FIG. 4 is an exploded view of the glove after stitching worn on the hand of a player.

Referring now to FIGS. 3 and 4, there is shown the glove in unstitched form and completed stitched form, respectively. The glove includes a first member 20 having thumb portion 22, index finger portion 24, middle finger portion 26, and a hand portion 27. Thumb portion 22 extends from the proximal end in a generally straight edge and curves in an arcuate path towards the distal end 23 where it curves sharply and then extends in a generally straight edge to the junction 25 of the thumb and index finger. The index finger portion 24 extends straight and then curves slightly towards the distal end 27 where it curves sharply and then extends generally straight towards the junction 29 of the index finger and middle finger. The middle finger portion extends generally in a straight edge and then curves slightly towards the distal end 31 where it curves sharply and then curves slightly towards the junction 33 between the middle finger and the ring finger. The hand portion 27 extends from junction 33 in a straight edge 34 to the proximal end and then extends at an obtuse angle in a straight edge 35. At about the middle of edge 34 there is formed a slit opening 38 which extends at right angles to edge 34 towards and in close proximity to junction 25 of the thumb and index finger. The slit opening enhances the fit and firmness of the glove when in the completed stitched form as will become more apparent hereinafter.

A second member 40 in mirror symmetry to member 20 includes a thumb portion 42, an index finger portion 44, a middle finger portion 46 and a hand portion 47, straight edges 51, 52, and slit opening 58. When the members 20 and 40 are joined together along the edges of the thumb, index finger and middle finger portions extending to junction 33, a glove is formed covering the thumb, index, and middle fingers leaving an opening remaining along straight edges 34 and 51 of the hand portions to accommodate the ring and small fingers on the player's hand.

The glove is assembled by stitching the members 20 and 40 along the edges thereof together with stitches 65 extending along the edges in a straight edge seam except that the members are not stitched together along straight edges 34, 35 and 51, 52 of the hand portions 27 and 47, respectively. Thus, an opening remains to accommodate the ring and small fingers of the hand. When the stitched glove is turned inside out, a finished two handed glove is formed. Slit openings 38 and 58 are stitched closed separately. Desirably edges 34 and 51 along the opening are tucked inside and stitched separately to provide a fully finished appearance. By this structure, the glove can be worn on either hand of the player without sacrifice in comfort or inconvenience to the player.

At one end of the glove along the straight edges 35 and 52 an elastic band 72 is stitched to the members 20 and 40. Elastic band 72 has an adjustable fastener portion in the form of VELCRO minute loop and pile fastener material pads 74 and 76 to facilitate adjusting and taking the glove off and on the hand.

Desirably, the glove is made of a soft, stretchable material that wears well. Any suitable material can be used, such as nylon. The stretch allows use of a range of different hand sizes. Formed in the material is a plurality of small openings 81 to ensure sufficient ventilation and comfort to the player. After stitching, the glove can be sprayed with a silicone lubricant to enhance the smooth finish for ease in handling the cue.

It will now be appreciated that the billiard glove according to the present invention has the advantage of being worn on either hand of the player depending upon his use without sacrifice in playing skill. Furthermore, the glove is made to fit comfortably and securely to the hand. With the unique design, fit and construction, the glove is simple to make and relatively inexpensive.

It will be understood that additional modifications and variations of the present invention are possible. It is therefore understood that within the scope of the appended claims, the invention may be practiced otherwise then, as specifically described herein.

What I claim is:

1. Glove means for use in billiards comprising:

a first member having edges defining a thumb portion, an index finger portion, a middle finger portion, and hand portion, a second member with edges in mirror symmetry to said first member and having corresponding thumb, index finger, middle finger, and hand portion, said hand portions having straight edge portions and wherein each of said hand portions is formed with a slit opening at about the middle of at least one of the straight edge portions, said slit opening extending at right angles thereto in close proximity to the junction between the thumb and index finger portions, each of said slit openings being stitched separately to close said openings, said first and second members being stitched together by straight stitches along the edges extending between the thumb and middle finger portions but remaining unstitched in the straight edge portions of said hand portions so that a smoothly fitted glove is made for right and left hand use of a billiard player.

2. Glove means according to claim 1 wherein said members are made from soft stretchable material formed with tiny openings for ventilation.

3. Glove means according to claim 2 wherein said material is sprayed with a silicone lubricant to enhance the smooth finish thereof.

4. Glove means according to claim 1 wherein an elastic strap and strap securing means are stitched to the said members.

5. Glove means according to claim 1 wherein the edges of each of the hand portions are tucked inwardly and stitched to provide a smooth finished surface along the entire glove.

* * * * *